US006046534A

United States Patent [19]

Horiuchi

[11] Patent Number: 6,046,534

[45] Date of Patent: Apr. 4, 2000

[54] COLOR SELECTING ELECTRODE FOR COLOR CATHODE-RAY TUBE

[75] Inventor: Yoshiro Horiuchi, Tokyo, Japan

[73] Assignee: Sony Corporation, Japan

[21] Appl. No.: 09/035,020

[22] Filed: Mar. 5, 1998

[30] Foreign Application Priority Data

Mar. 7, 1997 [JP] Japan ..... 9-053609

[51] Int. Cl.[7] ..... H01J 29/80

[52] U.S. Cl. ..... 313/402; 313/407

[58] Field of Search ..... 313/402, 404, 313/405, 407

[56] References Cited

U.S. PATENT DOCUMENTS 5,801,479 9/1998 Shinoda ..... 313/407

*Primary Examiner*—Vip Patel

*Attorney, Agent, or Firm*—Rader, Fishman & Grauer; Ronald P. Kananen

[57] ABSTRACT

A color selecting electrode for a color cathode-ray tube, which is capable of optimizing a displacement of the color selecting electrode on a phosphor screen side when the color election mechanism is subjected to a thermal effect. The color selecting electrode includes a frame composed of a pair of opposed supporting members and a pair of elasticity imparting members mounted between the supporting members; a large-number of ribbon-like grid elements stretchingly mounted on the frame; and metal members different in thermal expansion coefficient from the supporting members, the metal members being fixed on the supporting members over the entire lengths thereof.

7 Claims, 13 Drawing Sheets

COLOR SELECTING ELECTRODE FOR COLOR CATHODE-RAY TUBE

BACKGROUND OF THE INVENTION

The present invention relates to a color selecting electrode for a color cathode-ray tube.

As a color selecting electrode used for a color cathode-ray tube, there is known a color selecting electrode, called an "aperture grill", shown in FIG. 9.

A color selecting electrode 1 shown in FIG. 9 includes a frame 6 composed of a pair of supporting members 2 and 3, and elasticity imparting members 4 and 5. The supporting members 2 and 3, each being L-shaped in cross-section, are disposed in parallel to each other with a specific gap put therebetween. The elasticity imparting members 4 and 5, each being substantially U-shaped in cross-section, are mounted to both the supporting members 2 and 3 at points, called "Bessel points", positioned inward from end portions of the supporting members 2 and 3. A large number of ribbon-like grid elements 7, arranged with a specific pitch, are mounted between both the supporting members 2 and 3 in such a manner as to be applied with a specific tensile strength, to thus form slit-like electron beam apertures 8 each between adjacent ones of the grid elements 7.

In such a color selecting electrode 1, to support the color selecting electrode 1 on an inner surface of a panel of a cathode-ray tube body at three or four points (four points in this example), supporting springs 10 (10*a* to 10*d*) are welded through spring holders 9 (9*a* to 9*d*) on four sides of the frame 6, that is, the supporting members 2 and 3 and the elasticity imparting members 4 and 5. Each of the supporting springs 10 (10*a* to 10*d*) has at its tip an engagement hole 11 to which a panel pin is to be fitted.

The color selecting electrode 1 is, as shown in FIG. 10, mounted to a panel 12 of a cathode-ray tube by fitting panel pins 13 (13*a* to 13*d*) provided on an inner surface of the panel 12 in the engagement holes 11 of the supporting springs 10 (10*a* to 10*d*), respectively.

Incidentally, in a color cathode-ray tube using the color selecting electrode 1 having such a configuration, the grid elements 7 generate heat due to electron beams upon operation of the color cathode-ray tube, and the heat thus generated is partially transmitted to the frame 6. As a result, the frame 6 is thermally expanded, to cause mislanding of electron beams.

To be more specific, as shown in FIG. 11, when the pair of the supporting members 2 and 3 are thermally expanded in the longitudinal direction as shown by a broken line due to a thermal effect of the frame 6, the grid elements 7 are correspondingly displaced as shown by a broken line. Accordingly, electron beam apertures 8, particularly, positioned at a peripheral portion are displaced as shown by a broken line. Thus, an electron beam 15, which is expected to reach a specific position $P_1$ on a phosphor screen 16 through a specific electron beam aperture 8 located at a position $A_1$ before thermal expansion, reaches a position $P_2$ on the phosphor screen 16 through an electron beam aperture 8 displaced to a position $A_2$ shown by a broken line 15' after thermal deformation of the supporting members 2 and 3 of the frame 6. This results in occurrence of mislanding of the electron beam 15.

To correct such a mislanding due to thermal expansion of the frame 6, a temperature drift correcting means having a bimetal structure has been provided on the color selecting electrode 1.

The temperature drift correcting means is so configured as shown in FIG. 9. To be more specific, each of the spring holders 9*a* and 9*b* respectively fixed on the supporting members 2 and 3 of the frame 6 has a bimetal structure. Further, a metal member 18 having a thermal expansion coefficient larger than each of the elasticity imparting members 4 and 5 is fixed on a back surface of each of the elasticity imparting members 4 and 5, and forms a bimetal structure in combination thereof.

Each of the spring holders 9*a* and 9*b* has the bimetal structure in which an outer metal member 19 having a larger thermal expansion coefficient is stuck on an inner metal member 20 having a small thermal expansion coefficient, and at an intermediate position an inwardly curved U-shape portion 21.

The temperature drift correcting means having such a bimetal structure is intended to displace the thermally expanded frame 6 on the phosphor screen 16 side as shown in FIG. 12 and hence to avoid occurrence of mislanding of electron beams.

To be more specific, when the frame 6 is thermally expanded from a state in which the frame 6 is subjected to no thermal effect (shown by a solid line) and thereby an arbitrary electron beam aperture 8 at a peripheral portion of the grid elements 7 is displaced from a position $A_1$ to a position $A_2$, the frame 6 is displaced to a state shown by a broken line so that the electron beam aperture 8 is shifted to a position $A_3$ on a locus of an electron beam 15 passing through the above electron beam aperture 8 in a state in which the frame 6 is not deformed, to allow the electron beam 15 to reach a specific target position $P_1$ on a phosphor screen 16.

Incidentally, in a high definition color cathode-ray tube (for example, a so-called non-consumer color cathode-ray tube such as a monitor tube for a computer) in which a pitch of each color phosphor layer on a phosphor screen is made finer, a landing margin for electron beams is extremely smaller than that of a consumer color cathode-ray tube.

In the case where the color selecting electrode 1, shown in FIG. 9, using the spring holders 9*a* and 9*b* and the elasticity imparting members 4 and 5 each having a bimetal structure is applied to such a high definition color cathode-ray tube, it is difficult to obtain an optimum correction for mislanding because a displacement of the color selecting electrode 1 by the bimetal structures is insufficient.

With respect to a displacement of the color selecting electrode 1, the displacement due to the spring holders 9*a* and 9*d*, each having the bimetal structure, fixed on the supporting members 2 and 3 is larger than the displacement due to the metal members 18 fixed on the elasticity imparting members 4 and 5. As a result, an attempt has been made to increase the displacement by making thin the thickness of each of the spring holders 9*a* and 9*d* having the bimetal structure or enlarging the U-shaped portion 21; however, an effect obtained by such an attempt is insufficient.

Also, if the thickness of each of the spring holders 9*a* and 9*d* having the bimetal structure is made thin, an impact resistance of a cathode-ray tube (that is, Braun tube) is deteriorated. Besides, if the U-shaped portion 21 is enlarged, there is a limitation in terms of its formed shape because there may occur cracks upon press-forming of the enlarged U-shaped portion 21. Accordingly, at present condition, it is difficult to obtain the optimum displacement of the color selecting electrode 1.

Further, since the color selecting electrode 1 is displaced by curving of the spring holders 9*a* and 9*b* each having the bimetal structure, a fitting position between the panel pin 13 and the supporting spring 10 is changed, so that the supporting spring 10 is caught by the panel pin 13 due to the change in fitting position and thereby it is not returned to the original state. This causes a variation in landing of electron beams.

On the other hand, there is known another related art color selecting electrode shown in FIG. 13. In a color selecting electrode 25 shown in FIG. 13, a metal member 24 different in thermal expansion coefficient from each of a pair of supporting members 2 and 3 is fixed at a central portion of a back surface of each of the supporting members 2 and 3 which back surface is opposed to a surface on which grid elements 7 are mounted, and forms a bimetal structure in combination thereof.

The color selecting electrode 25, however, has a problem. When the color selecting electrode 25 is subjected to a thermal effect, displacements at both end portions of each of the supporting members 2 and 3 having the bimetal structure are small. As a result, the color selecting electrode 25 cannot be practically used.

SUMMARY OF THE INVENTION

An object of the present invention is to provide a color selecting electrode for a color cathode-ray tube capable of optimizing a displacement of the color selecting electrode on a phosphor screen side when the color selecting electrode is subjected to a thermal effect, thereby making small mislanding of electron beams at a peripheral portion of a screen.

To achieve the above object, according to the present invention, there is provided a color selecting electrode for a color cathode-ray tube, including: a frame composed of a pair of opposed supporting members and a pair of elasticity imparting members mounted between the supporting members; a large number of ribbon-like grid elements stretchingly mounted on the frame; and metal members different in thermal expansion coefficient from the supporting members, the metal members being fixed on the supporting members over the entire lengths thereof.

According to the present invention, since a metal member different in thermal expansion coefficient from each of a pair of supporting members of a frame is fixed on each of the supporting members over the entire length, the entire supporting member can be curvedly displaced on the phosphor screen side due to a difference in thermal expansion coefficient between the supporting member and the metal member.

As a result, it is possible to enlarge a displacement of an each end portion of the supporting member for optimizing the displacement of the color selecting electrode on the phosphor screen side, and hence to make smaller mislanding of electron beams at a peripheral portion.

In the above color selecting electrode, the metal members smaller in thermal expansion coefficient than the supporting members may be fixed on front surfaces, of the supporting members, facing to the ribbon-like grid elements.

The metal members larger in thermal expansion coefficient than the supporting members may be fixed on back surfaces, of the supporting members, opposed to the front surfaces on which the ribbon-like grid elements are stretchingly mounted.

A difference in thermal expansion coefficient between the supporting member and the metal member may be $5.0\times10^{-6}$/°C. or more. With this configuration, it is possible to optimize a displacement of the color selecting electrode by the bimetal structure of the supporting member and the metal member.

The metal member mounted on one of the supporting members may be made different in mechanical strength and thermal expansion coefficient from the metal member mounted on the other of the supporting members in accordance with supporting positions at which the elasticity imparting members are supported on an inner surface of a panel. With this configuration, even when the supporting position is offset from the center of each elasticity imparting member, a displacement of one supporting member is set to be equal to that of the other supporting member, and thereby the color selecting electrode can be uniformly displaced on the phosphor screen side.

A position at which each of the elasticity imparting members may be supported on an inner surface of a panel is offset from a center of the elasticity imparting member; and a difference in mechanical strength between the metal member mounted on one of the supporting members and the metal member mounted on the other of the supporting members is set at 1.1 times or more. With this configuration, it is possible to optimize adjustment in displacement of both the supporting members.

The metal member may be fixed on each of the supporting members along a shape of the supporting member. With this configuration, it is possible to ensure a desirable bimetal action in combination of the metal member and the supporting member, and hence to obtain large displacement.

DETAILED DESCRIPTION OF THE PREFERRED EMBODIMENTS

Hereinafter, embodiments of the present invention will be described with reference to the drawings.

Figure 1:
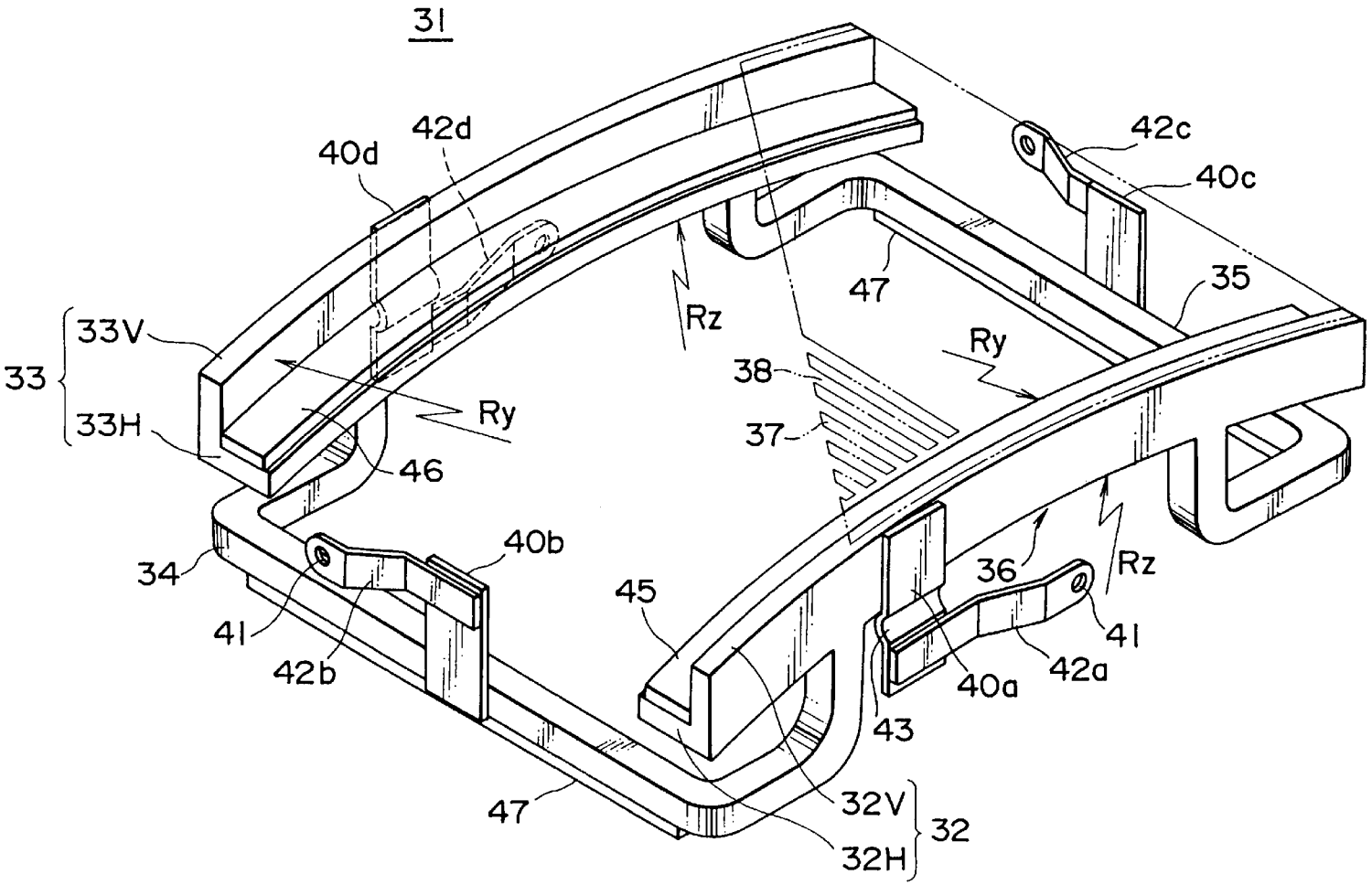
FIG. 1 is a view showing a configuration of a first embodiment of a color selecting electrode of a color cathode-ray tube according to the present invention.

FIG. 1 shows a first embodiment of a color selecting electrode for a color cathode-ray tube according to the present invention.

A color selecting electrode 31 has a metal frame 36 composed of a pair of supporting members 32 and 33, and elasticity imparting members 34 and 35. The supporting members 32 and 33, each being L-shaped in cross-section, are disposed in parallel to each other oppositely with a specific gap put therebetween. The elasticity imparting members 34 and 35, each being substantially U-shaped, are mounted on both the supporting members 32 and 33 at points, called "Bessel points", positioned inwardly from end portions of the supporting members 32 and 33. A large number of ribbon-like grid elements 37, arranged with a specific pitch, are mounted between both the supporting members 32 and 33, more specifically, between upper surfaces of vertical portions 32V and 33V of the L-shaped supporting members 32 and 33 in such a manner as to be stretched with a specific tensile strength, to thus form slit-like electron beam apertures 38 each between adjacent ones of the grid elements 37.

Spring holders 40 (40*a* to 40*d*) are fixed by welding or the like on four sides of the frame 36, that is, on the supporting members 32 and 33 and the elasticity imparting members 34 and 35. Supporting springs 42 (42*a* to 42*d*), each having at its tip an engagement hole 41 to which a panel pin is to be fitted, are fixed by welding or the like on the spring holders 40 (40*a* to 40*d*), respectively. Each of the spring holders 40*a* and 40*d* fixed on the supporting members 32 and 33 can be formed into a shape having at an intermediate position an inwardly curved U-shaped portion 43.

In this embodiment, a metal member 45 (46), which is smaller in thermal expansion coefficient than the supporting member 32 (33), is fixed by welding or another means particularly on a surface, of the supporting member 32 (33), facing to the grid elements 37, that is, on a front surface, of a horizontal portion 32H (33H) of the L-shaped supporting member 32 (33), facing to the grid elements 37, in such a manner as to extend over the length of the supporting member 32 (33).

The metal member 45 (46) is made from a metal material specified such that a difference in thermal expansion coefficient between the supporting member 32 (33) and the metal member 45 (46) is $5.0\times10^{-6}$/°C. or more.

Each of the supporting members 32 and 33 is curved at a specific curvature (radius of curvature: $R_Z$) in the Z direction perpendicular to a mounting plane of the grid elements 37 in order to be matched with a cylindrical panel plane, and it is also curved at a specific curvature (radius of curvature: $R_Y$) in the Y direction in which the supporting members 32 and 33 face to each other.

Accordingly, the metal member 45 (46) is formed into a shape being matched with the curvatures of the supporting member 32 (33) in the Y direction and the Z direction, and is fixed on the supporting member 32 (33) in such a manner as to extend along the shape of the supporting member 32 (33).

Further, in this embodiment, a metal member 47 larger in thermal expansion coefficient than that of each of the pair of the elasticity imparting members 34 and 35 of the frame 36 is fixed by welding or another means on a back surface, of each of the elasticity imparting members 34 and 35, opposed to the side of the grid elements 37.

Even in this case, the metal member 47 is made from a metal material specified such that a difference in thermal expansion coefficient between each of the elasticity imparting members 34 and 35 and the metal member 47 is $5.0\times10^{-6}$/°C. or more.

Figure 3:
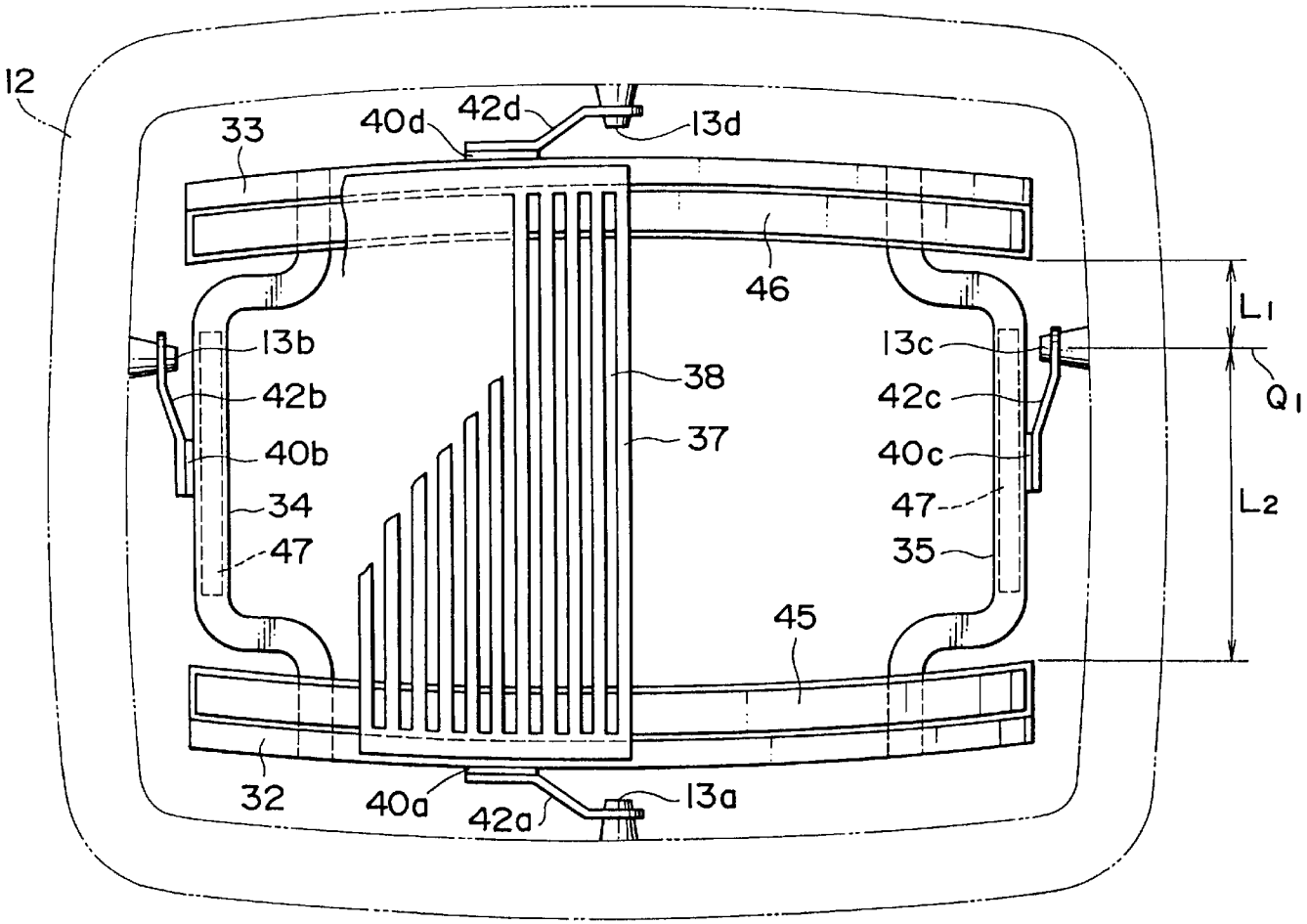
FIG. 3 is a view showing a state in which the color selecting electrode shown in FIG. 1 is mounted at four points on an inner surface of a panel of a cathode-ray tube.

The color selecting electrode 31 is, as shown in FIG. 3, mounted to a panel 12 of a cathode-ray tube as described above, by fitting panel pins 13 (13*a* to 13*d*) provided integrally on an inner surface of the panel 12 into the engagement holes 41 of the supporting springs 42 (42*a* to 42*d*), respectively.

In this color selecting electrode 31, the supporting member 32 (33) and the metal member 45 (46) constitute a bimetal structure, and the elasticity imparting member 34 (35) and the metal member 47 constitute a bimetal structure. With both the bimetal structures, the color selecting electrode 31 is displaced to the phosphor screen side when being subjected to a thermal effect.

Figure 8:
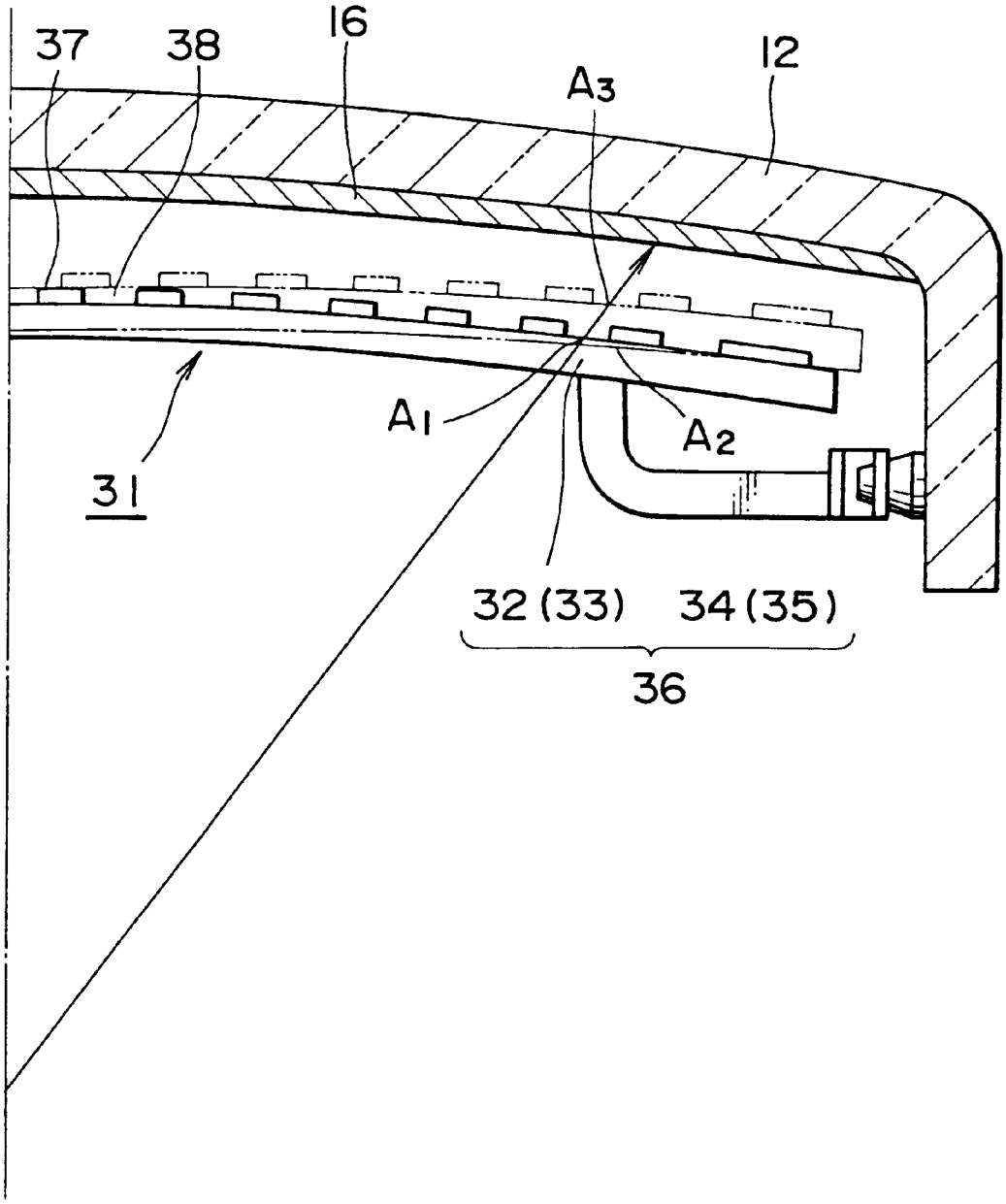
FIG. 8 is a view illustrating an operational state of the color selecting electrode for a color cathode-ray tube according to the present invention.
Figure 9:
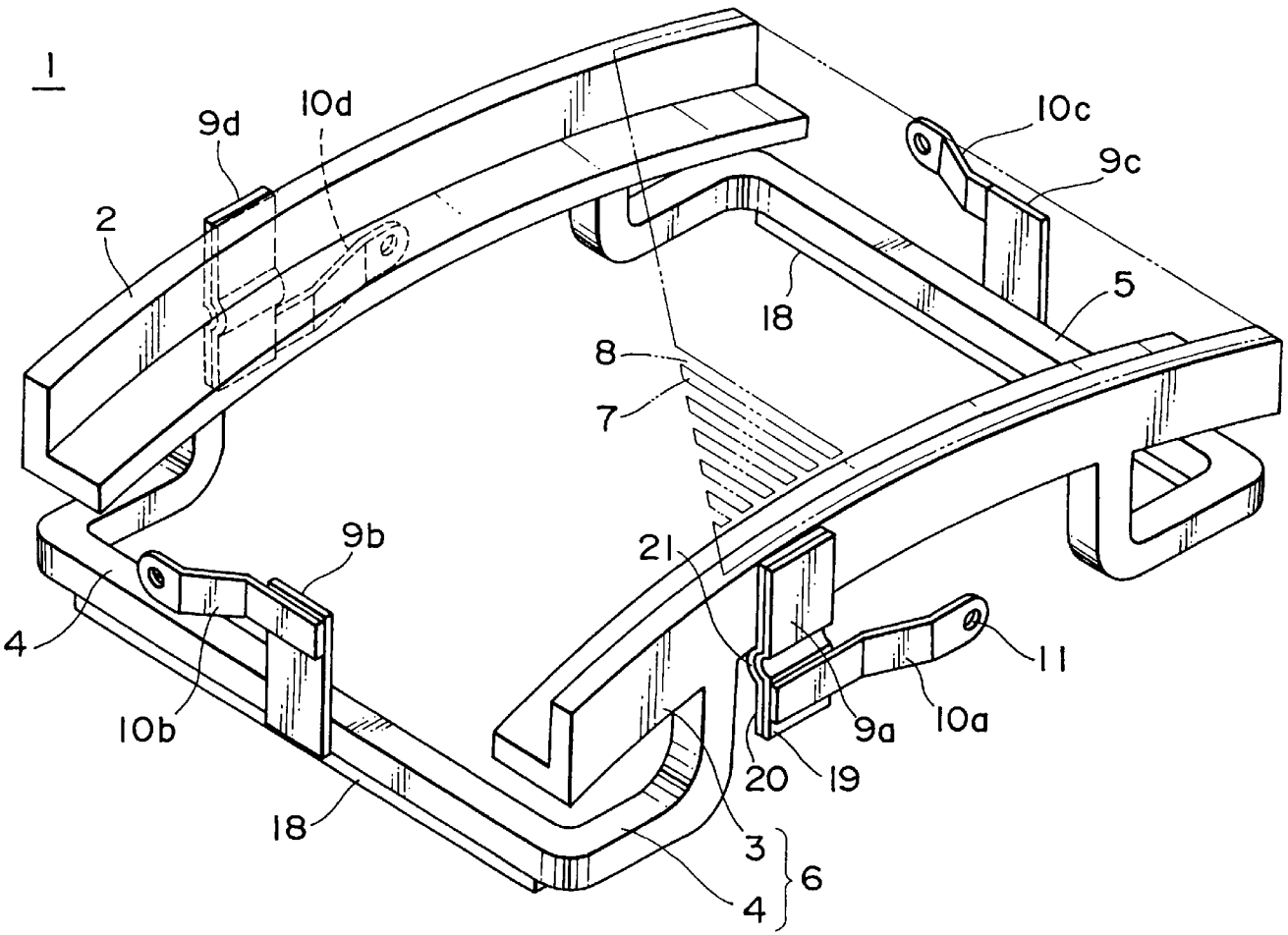
FIG. 9 is a view showing a configuration of a related art color selecting electrode for a color cathode-ray tube.
Figure 10:
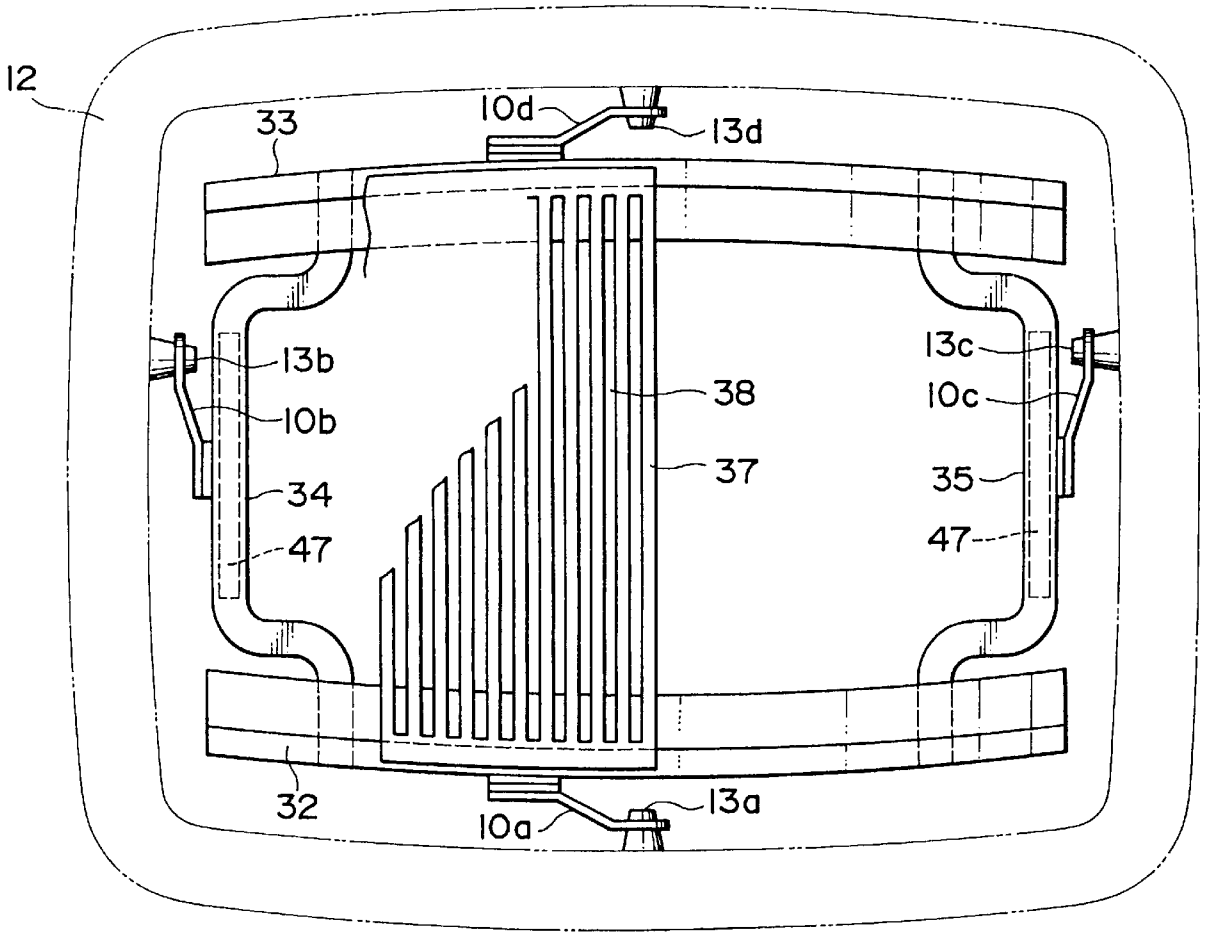
FIG. 10 is a view showing a state in which the color selecting electrode shown in FIG. 9 is mounted on an inner surface of a panel.
Figure 11:
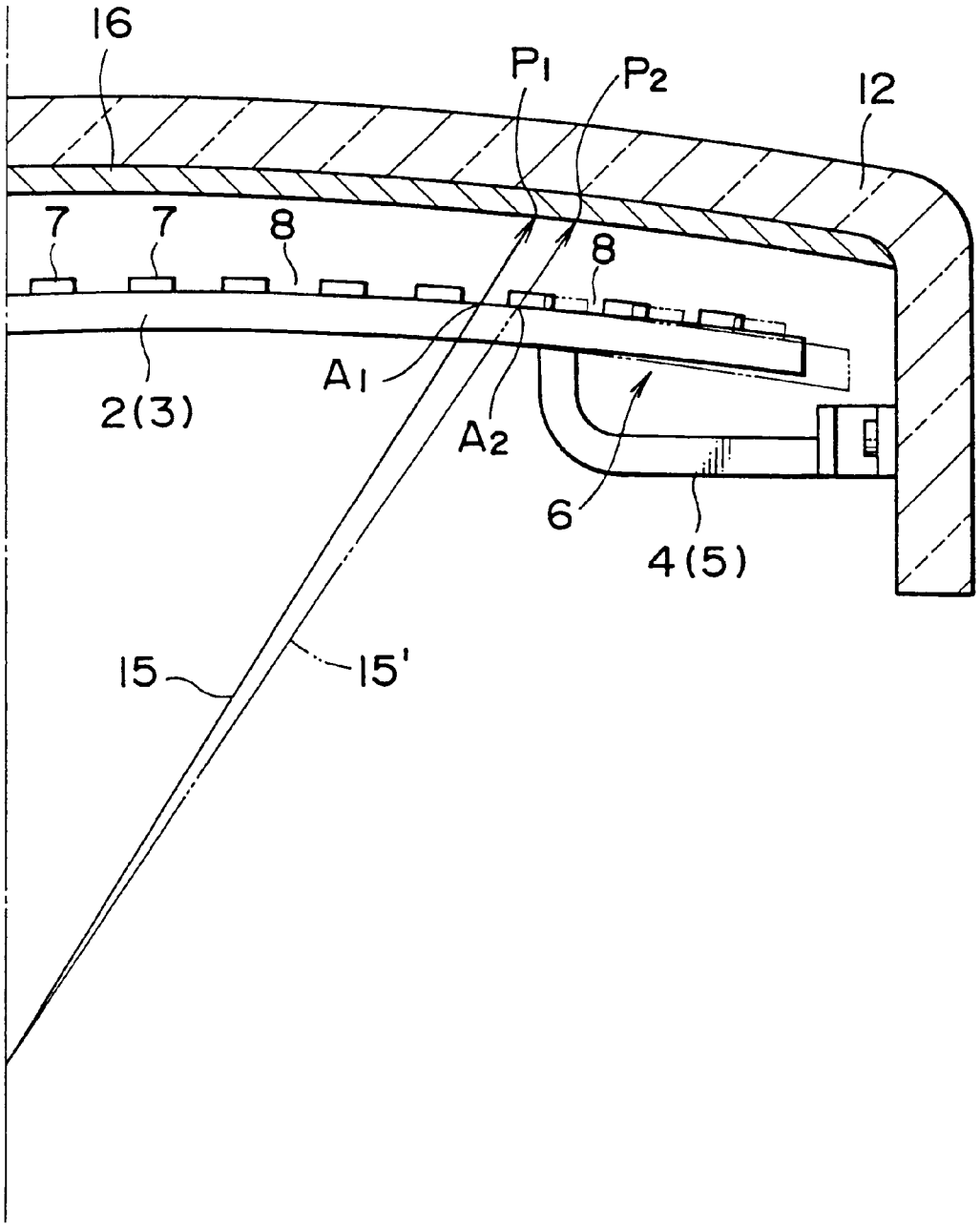
FIG. 11 is a view illustrating mislanding of electron beams.
Figure 12:
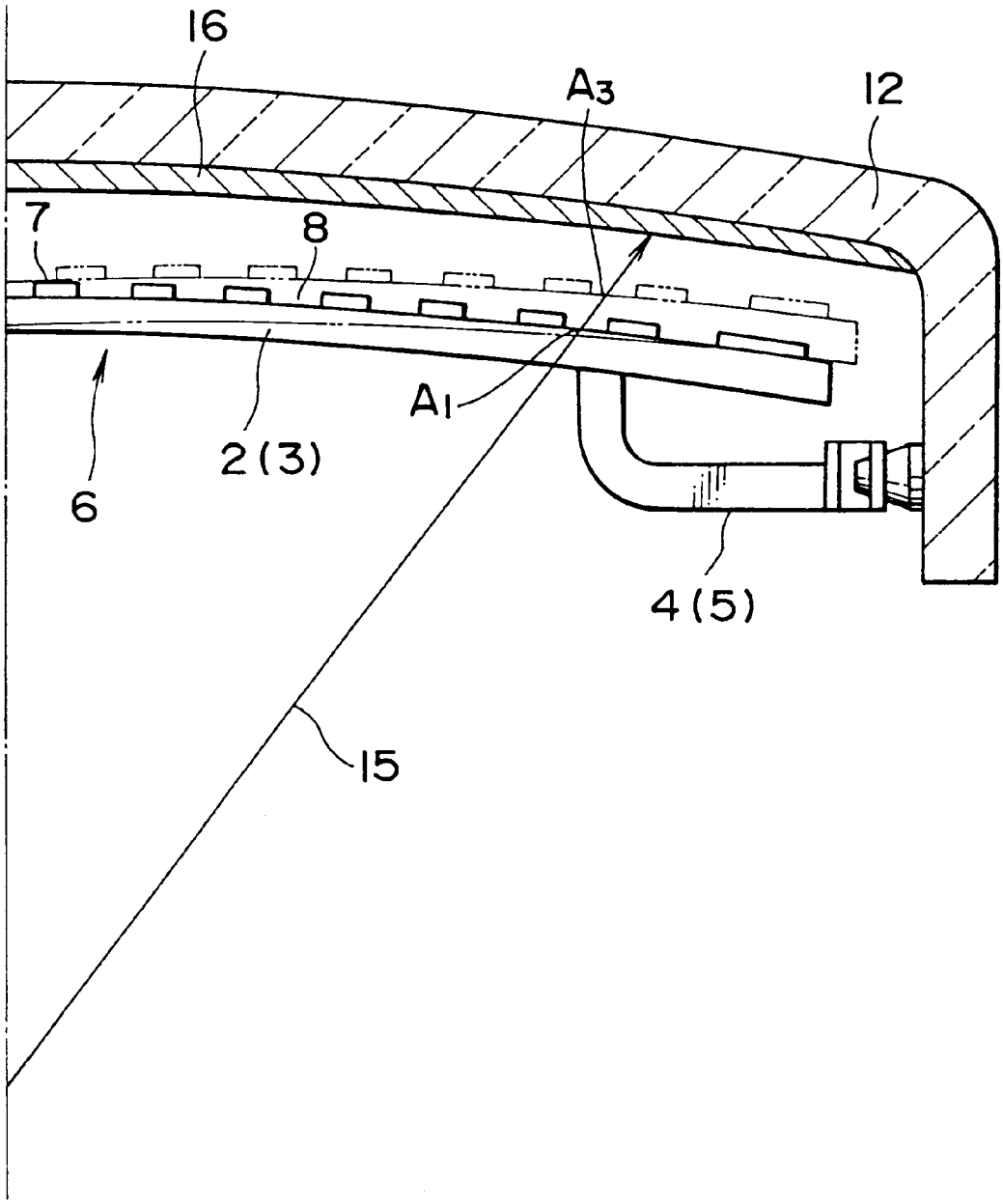
FIG. 12 is a view showing a principle of an operational state of a color selecting electrode.
Figure 13:
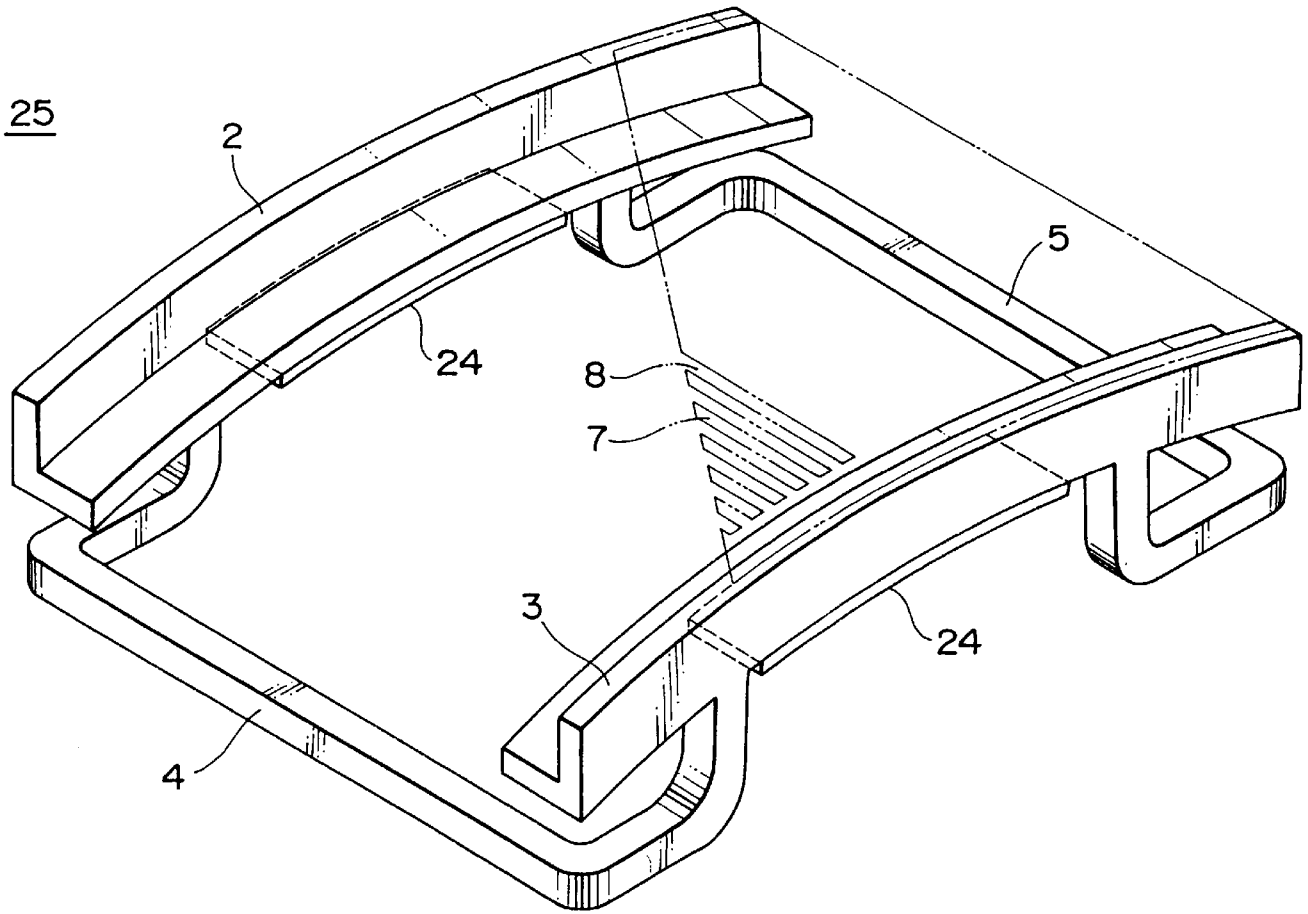
FIG. 13 is a view showing a configuration of another related art color selecting electrode for a color cathode-ray tube.

To be more specific, as shown in FIG. 8, when the frame 36 of the color selecting electrode 31 is thermally expanded in the longitudinal direction of the supporting members 32 and 33 from a state (shown by a solid line in the figure) in which the frame 36 is subjected to no thermal effect and thereby an arbitrary electron beam aperture 38 at a peripheral portion of the grid elements 37 is displaced from a position $A_1$ to a position $A_2$, such an electron beam aperture 38 can be displaced to a position $A_3$ on a locus of an electron beam 15 passing through the electron beam aperture 38 in the state that the frame 36 is not deformed (shown by a broken line in the figure).

With the color selecting electrode 31 having a such configuration, the metal member 45 (46) smaller in thermal expansion coefficient than the supporting member 32 (33) is fixed on the front surface, of the supporting member 32 (33), facing to the grid elements 37 in such a manner as to extend over the entire length of the supporting member 32 (33), and accordingly, when being subjected to a thermal effect, the color selecting electrode 31 makes it possible to enlarge a displacement of, particularly, each end portion of the supporting member 32 (33), and hence to make small misland-ing of electron beams, particularly, at a peripheral portion of the screen.

Upon displacement of the color selecting electrode 31 on the phosphor screen side, the supporting springs 40*a* and 40*d* are not curved differently from the related art mechanism. As a result, the supporting springs 40*a* and 40*d* are prevented from being caught by the panel pins 13, to thereby reduce a variation in landing of electron beams.

In particular, by setting a difference in thermal expansion coefficient between the supporting member 32 (33) and the metal member 45 (46) at a value of $5.0\times10^{-6}$/°C. or more, it is possible to optimize a displacement of the color selecting electrode 31 on the phosphor screen 16 side when the color selecting electrode 31 is subjected to a thermal effect.

By forming the metal member 45 (46) into a shape being matched with the curvature of the supporting member 32 (33) and fixing it on the supporting member 32 (33) along the shape, that is, the curved surface of the supporting member 32 (33), it is also possible to optimize a displacement of the color selecting electrode 31 on the phosphor screen 16 side.

Figure 7A:
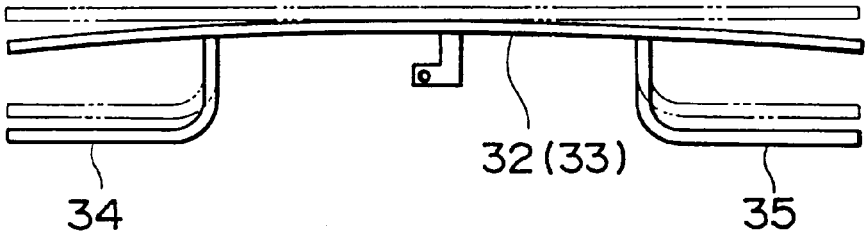
FIGS. 7A and 7B are a top view and a side view showing a state in which the color selecting electrode is deformed by thermal expansion.
Figure 7B:
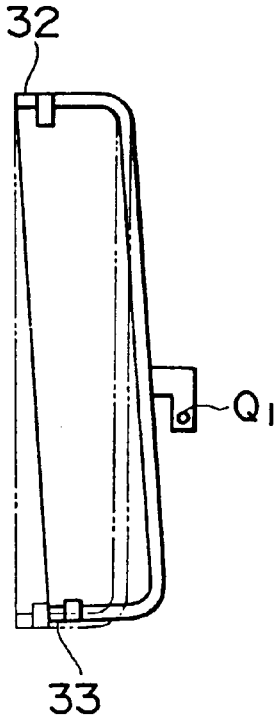

On the other hand, although when the frame 36 is subjected to a thermal effect, the supporting member 32 (33) is curvedly deformed due to a difference in thermal expansion coefficient between the supporting member 32 (33) and the metal member 45 (46), the elasticity imparting member 34 (35) connected to the supporting member 32 (33) is rotated around a fitting portion between the supporting spring 42*b* (42*c*) and the panel pin 13*b* (13*c*), as shown in FIGS. 7A and 7B. As a result, there possibly occurs a difference in a curved deformation between the supporting members 32 and the supporting member 33.

To be more specific, as shown in FIG. 3, in the case where a supporting position $Q_1$, to the panel pin 13*b* (13*c*), of the supporting spring 42*b* (42*c*) mounted on the elasticity imparting member 34 (35) is offset from a center of the elasticity imparting member 34 (35), the elasticity imparting member 34 (35) is rotated around the supporting position $Q_1$ as shown in FIG. 7B if the metal members 45 and 46 are identical to each other in terms of thermal expansion coefficient and mechanical strength. As a result, a curved displacement of the supporting member 32 separated a long distance $L_2$ from the supporting position $Q_1$ becomes larger than that of the supporting member 33 separated a short distance $L_1$ from the supporting position $Q_1$.

To cope with such an inconvenience, the mechanical strength (plate thickness, plate width, length) of one of the metal members 45 and 46 fixed on the pair of the supporting members 32 and 33 is set to be 1.1 times or more larger than the other of the metal member 45 and 46; or the thermal expansion coefficient of one of the metal members 45 and 46 is made different from that of the other of the metal members 45 and 46 under such a limitation as to keep the difference in thermal expansion coefficient between the supporting member 32 (33) and the metal member 45 (46) at $5.0\times10^{-6}$/°C. or more.

For example, in the embodiment shown in FIG. 3 in which the color selecting electrode 31 is supported at four points, the mechanical strength of the metal member 46 fixed on the supporting member 33 separated the short distance $L_1$ from the supporting position $Q_1$, to the panel pin 13*b* (13*c*), of the supporting spring 42*b* (42*c*) mounted on the elasticity imparting member 34 (35), is set to be 1.1 times or more than that of the metal member 45 fixed on the supporting member 32 separated the long distance $L_2$ from the supporting position $Q_1$. In addition, the thermal expansion coefficient of the supporting member 32 is set to be the same as that of the supporting member 33.

Figure 5:
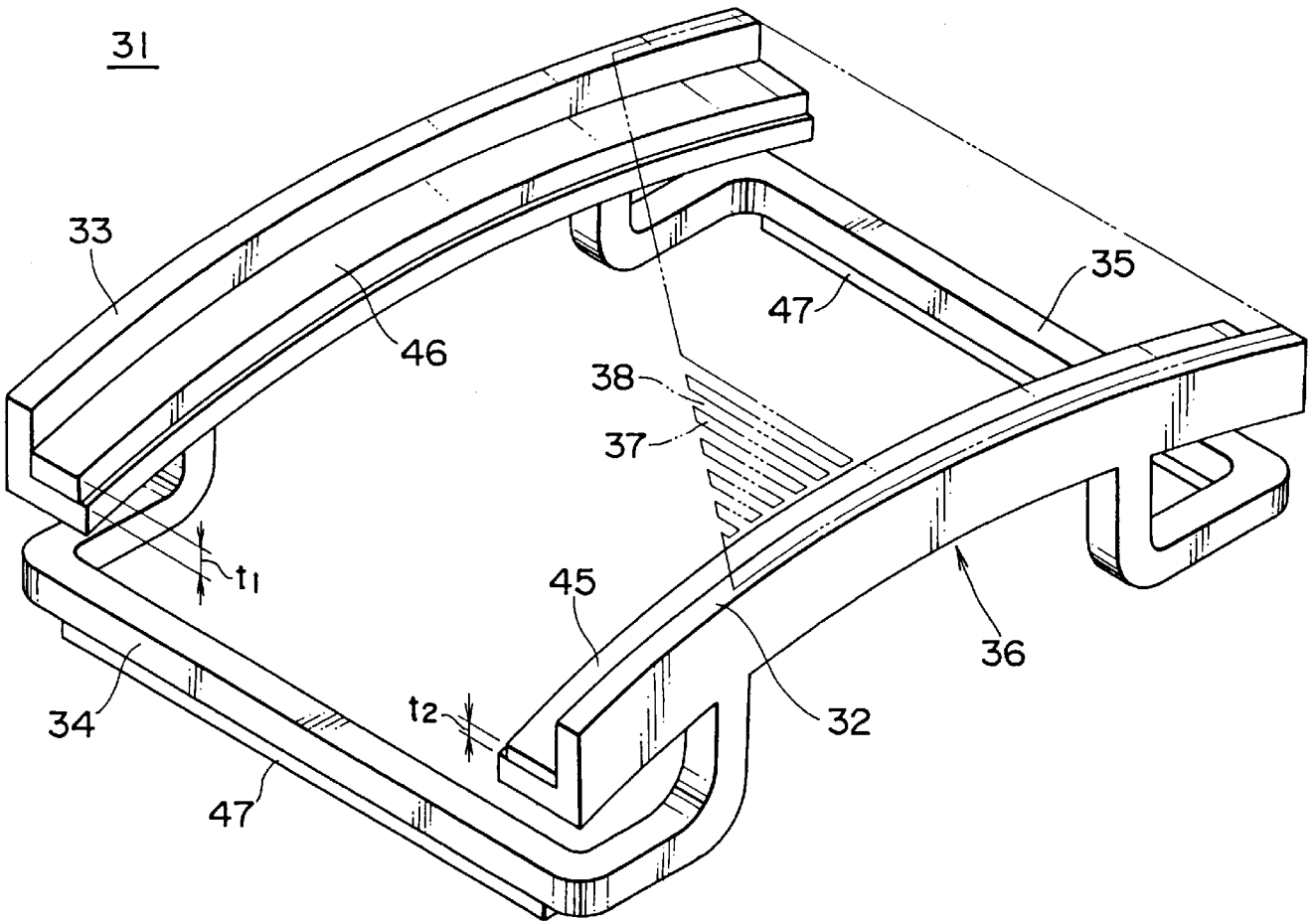
FIG. 5 is a view showing a configuration of another embodiment of the color selecting electrode for a color cathode-ray tube according to the present invention.

FIG. 5 shows another embodiment of the color selecting electrode 31 in which the mechanical strength of the metal member 45 is different from that of the metal member 46. In this embodiment, a plate thickness $t_1$ of the metal member 46 on one supporting member 33 side is set to be larger than a plate thickness $t_2$ of the metal member 45 on the other supporting member 32 side ($t_1>t_2$) to thus set the mechanical strength of the metal member 46 to be larger than that of the metal member 45. In this case, the thermal expansion of the metal member 45 is the same as that of the metal member 46.

In a further embodiment of the color selecting electrode 31, the mechanical strength of the metal member 45 is set to be the same as that of the metal member 46 and the thermal expansion coefficient of the metal member 46 fixed on the supporting member 33 separated the short distance $L_1$ from the supporting position $Q_1$ is set to be larger than that of the metal member 45 fixed on the supporting member 32 separated the long distance $L_2$ from the supporting position $Q_1$.

In this way, by setting the mechanical strength or the thermal expansion coefficient of the metal member 45 to be different from that of the metal member 46, it is possible to uniformly displace the color selecting electrode 31.

Figure 4:
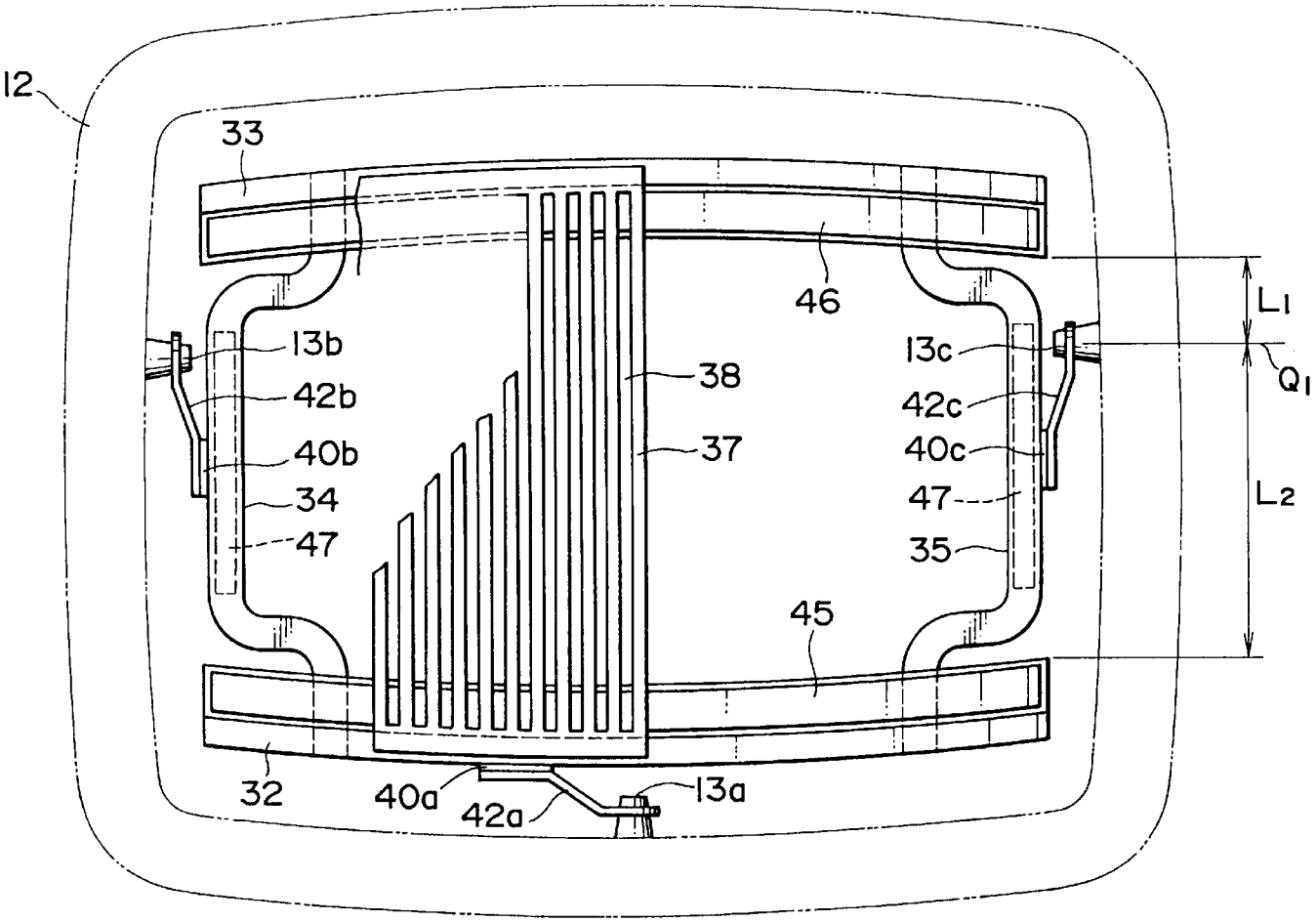
FIG. 4 is a view illustrating a state in which a three-point support type color selecting electrode of the present invention is supported at three points on an inner surface of a panel of a color cathode-ray tube.

On the other hand, as shown in FIG. 4, in the case where the fourth panel pin 13*d* is omitted, and the color selecting electrode 31 is supported at three points, that is, the first, second, and third panel pins 13*a*, 13*b* and 13*c*, the condition is reversed to that in the case where the color selecting electrode 31 is supported at the four points. To be more specific, the mechanical strength of the metal member 45 on one supporting member 32 side supported by the panel pin 13*a* is set to be 1.1 times or more than that of the metal member 46 on the other supporting member 33 side not supported by the panel pin; or the thermal expansion coefficient of the metal member 45 is set to be larger than that of the metal member 46.

Thus, in the case where the color selecting electrode 31 is supported by three points, the color selecting electrode 31 can be uniformly displaced.

Figure 2:
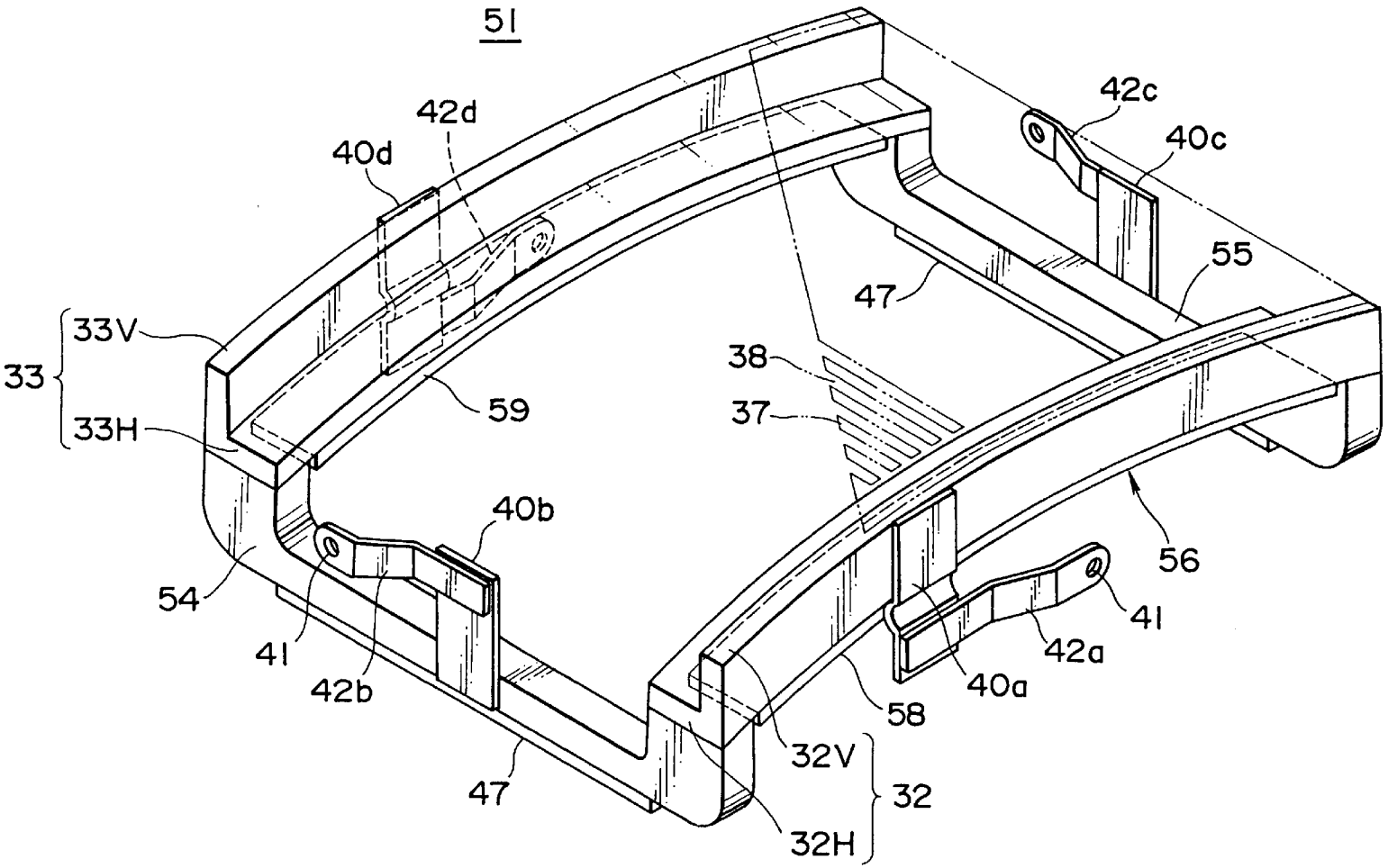
FIG. 2 is a view showing a configuration of a second embodiment of the color selecting electrode for a color cathode-ray tube according to the present invention.

FIG. 2 shows a second embodiment of the color selecting electrode of the present invention.

A color selecting electrode 51 includes a metal frame 56 composed of a pair of supporting members 32 and 33 and elasticity imparting members 54 and 55. The supporting members 32 and 33, each being L-shaped in cross-section, are disposed in parallel to each other oppositely with a specific gap put therebetween. The elasticity imparting members 54 and 55, each being substantially U-shaped in cross-section, are mounted on end portions of the supporting members 32 and 33. A larger number of ribbon-like grid elements 37, arranged with a specific pitch, are mounted on the frame 56 in such a manner as to be stretched with a specific tensile strength, to thus form slit-like electron beam apertures 38 each between adjacent ones of the grid elements 37.

In this embodiment, particularly, a metal member 58 (59) larger in thermal expansion coefficient than the supporting member 32 (33) is fixed by welding or another means on a back surface, of the supporting member 32 (33), opposed to the surface on which the grid elements 37 are mounted in such a manner as to extend along the shape of the supporting member 32 (33) over the entire length thereof.

In addition, the metal member 58 (59) extends over the entire length of the supporting member 32 (33) except for an end portion thereof on which the elasticity imparting member 54 (55) is mounted, and therefore, the metal member 58 (59) may be regarded to extend over the entire length of the supporting member 32 (33).

The metal member 58 (59) is made from a material specified such that a difference in thermal expansion coefficient between the supporting member 32 (33) and the metal member 58 (59) is $5.0\times10^{-6}$/°C. or more.

Further, a metal member 47, which has a thermal expansion coefficient larger than that of each of the elasticitity imparting members 54 and 55 like the embodiment in FIG. 1, is fixed by welding or another means on a back surface, of each of the pair of the elasticity imparting members 54 and 55 of the frame 56, opposed to the side of the grid elements 37.

The other configurations, that is, curved shapes of the supporting members 32 and 33, and the configurations of the spring holders 40 and supporting springs 42 are the same as those in FIG. 1, and parts corresponding to those in FIG. 1 are indicated by the same characters and the explanation thereof is omitted.

Even in the color selecting electrode 51 in this embodiment, the metal member 58 (59) larger in thermal expansion coefficient than the supporting member 32 (33) is fixed on the back surface, of the supporting member 32 (33), opposed to the surface mounted with the grid elements 37 in such a manner as to extend over the entire length of the supporting member 32 (33), and accordingly, when the color selecting electrode 51 is subjected to a thermal effect, a displacement of, particularly, each end portion of the supporting member 32 (33) on the phosphor screen side can be made larger, to thereby make small mislanding of electron beams, particularly, at a peripheral portion of the screen.

Upon displacement of the color selecting electrode 51 on the phosphor screen side, the supporting springs 40*a* and 40*d* are prevented from being caught by the panel pins 13, to thereby reduce a variation in landing of electron beams.

In addition, the same effect as that of the color selecting electrode 31 shown in FIG. 1 can be obtained in this embodiment.

Besides, even in the case of the color selecting electrode 51, like the embodiment shown in FIG. 3 or 4, when the supporting position, to the panel pin 13, of the elasticity imparting member 54 (55) is offset from the center of the elasticity imparting member 54 (55) upon mounting of the color selecting electrode 51 on an inner surface of the panel 12, the mechanical strength or thermal expansion coefficient of each of the metal members 58 and 59 is set in the same manner as that described in the color selecting electrode 31 shown in FIG. 1. Thus, like the color selecting electrode 31, the color selecting electrode 51 can be uniformly displaced on the phosphor screen side.

Figure 6:
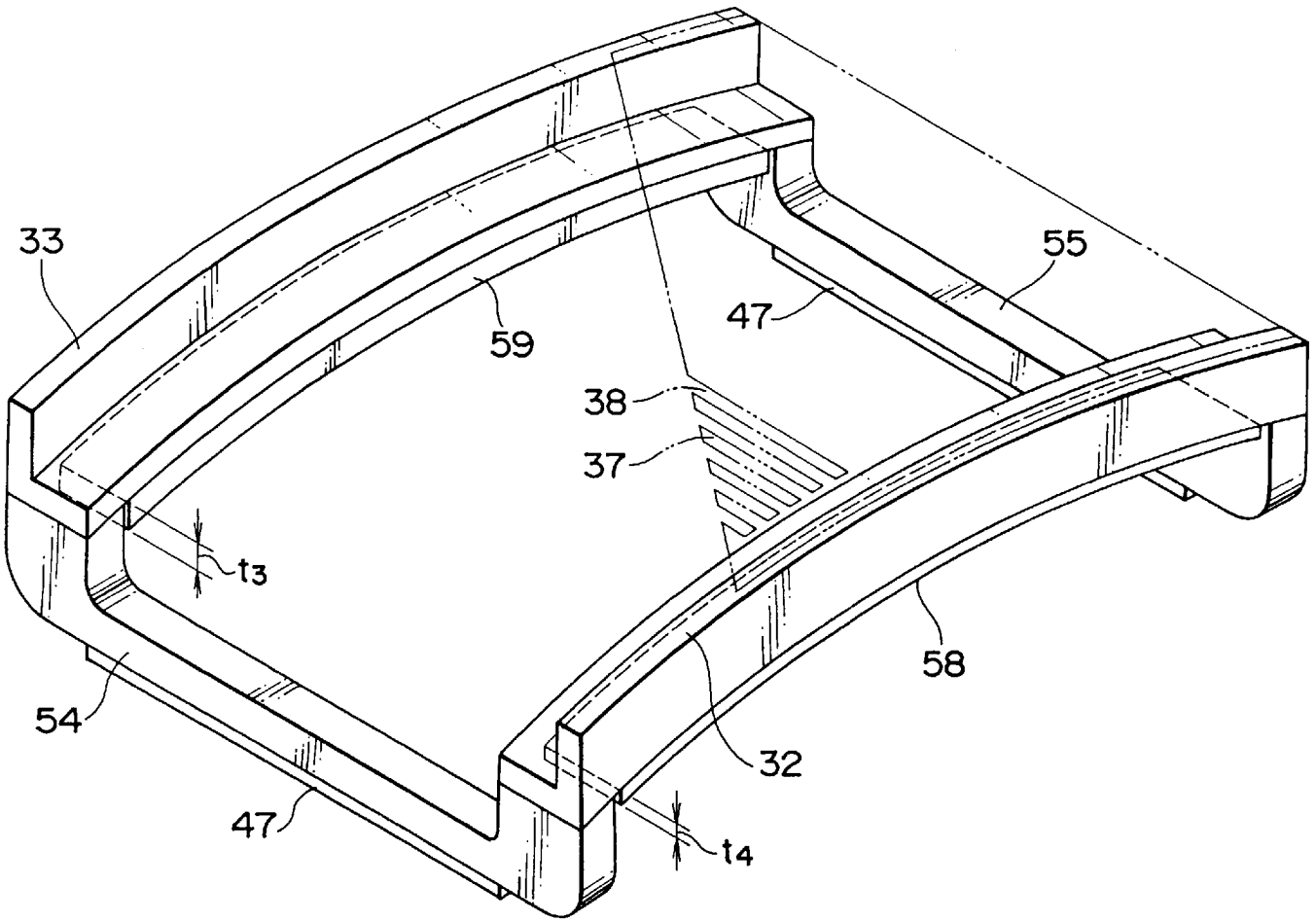
FIG. 6 is a view showing a configuration of a further embodiment of the color selecting electrode for a color cathode-ray tube according to the present invention.

FIG. 6 shows another embodiment of the color selecting electrode 51 in which the mechanical strength of the metal member 58 is different from that of the metal member 59. In this embodiment, a plate thickness $t_3$ of the metal member 59 on one supporting member 32 side is set to be larger than a plate thickness $t_4$ of the metal member 58 on the other supporting member 33 side ($t_3>t_4$), to make larger the mechanical strength of the metal member 59 than that of the metal member 58 for making a displacement of the supporting member 32 equal to that of the supporting member 33. In this case, the thermal expansion of the metal member 58 is the same as that of the metal member 59.

Alternatively, in a further embodiment of the color selecting electrode 51, the mechanical strength of the metal member 58 is set to be the same as that of the metal member 59, and the thermal expansion coefficient of the metal member 59 fixed on the supporting member 33 separated the short distance $L_1$ from the supporting position is set to be larger than that of the metal member 58 fixed on the supporting member 32 separated the long distance $L_2$ from the supporting position.

In this way, by setting the mechanical strength or the thermal expansion coefficient of the metal member 58 to be different from that of the metal member 59, it is possible to uniformly displace the color selecting electrode.

As described above, according to the embodiments of the present invention, by fixing the metal members 45 and 46 (58 and 59) different in thermal expansion coefficient from the pair of the supporting members 32 and 33 of the frame 36 (56) on the supporting members 32 and 33 over the entire lengths thereof, it is possible to enlarge a displacement of the color selecting electrode 31 (51) on the phosphor screen side when the color selecting electrode is subjected to a thermal effect, and hence to sufficiently reduce mislanding of electron beams, particularly, at a peripheral portion of the screen.

Since displacement of the color selecting electrode is not dependent on curving of the spring holders each having a bimetal structure, differently from the related art mechanism, the supporting spring 42 is prevented from being caught by the panel pin 13. As a result, it is possible to reduce a variation in landing of electron beams, and hence to stably produce a high quality color cathode-ray tube.

In the color selecting electrode 31 (51), by selecting the thermal expansion coefficient or mechanical strength of each of the metal members 45 and 46 (58 and 59), it is possible to design the optimum displacement of the color selecting electrode at a high degree of freedom for color cathode-ray tubes in a wide range from a small-sized tube to a large-sized tube.

Accordingly, by the use of the color selecting electrode 31 (51), it is possible to eliminate mislanding of electron beams due to thermal expansion of a frame, and hence to provide a high quality color cathode-ray tube.

What is claimed is:

1. A color selecting electrode for a color cathode-ray tube, comprising:

a frame composed of a pair of opposed supporting members and a pair of elasticity imparting members mounted between said supporting members;

a large number of ribbon-like grid elements stretchingly mounted on said frame; and metal members different in thermal expansion coefficient from said supporting members, said metal members being fixed on said supporting members over the entire lengths thereof.

2. A color selecting electrode for a color cathode-ray tube according to claim 1, wherein said metal members smaller in thermal expansion coefficient than said supporting members are fixed on front surfaces, of said supporting members, facing to said ribbon-like grid elements.

3. A color selecting electrode for a color cathode-ray tube according to claim 1, wherein said metal members larger in thermal expansion coefficient than said supporting members are fixed on back surfaces, of said supporting members, opposed to the front surfaces on which said ribbon-like grid elements are stretchingly mounted.

4. A color selecting electrode for a color cathode-ray tube according to claim 1, wherein a difference in thermal expansion coefficient between said supporting member and said metal member is $5.0\times10^{-6}$/°C. or more.

5. A color selecting electrode for a color cathode-ray tube according to claim 1, wherein said metal member mounted on one of said supporting members is made different in mechanical strength and thermal expansion coefficient from said metal member mounted on the other of said supporting members in accordance with supporting positions at which said elasticity imparting members are supported on an inner surface of a panel.

6. A color selecting electrode for a color cathode-ray tube according to claim 1, wherein a position at which each of said elasticity imparting members is supported on an inner surface of a panel is offset from a center of said elasticity imparting member; and a difference in mechanical strength between said metal member mounted on one of said supporting members and said metal member mounted on the other of said supporting members is set at 1.1 times or more.

7. A color selecting electrode for a color cathode-ray tube according to claim 1, wherein said metal members are fixed on each of said supporting members along a shape of said supporting member.

* * * * *